US007737317B1

(12) United States Patent
Schultz et al.

(10) Patent No.: US 7,737,317 B1
(45) Date of Patent: Jun. 15, 2010

(54) FRACTIONATION RECOVERY PROCESSING OF FCC-PRODUCED LIGHT OLEFINS

(75) Inventors: Michael A. Schultz, Chicago, IL (US); Jason T. Corradi, Arlington Heights, IL (US)

(73) Assignee: UOP LLC., Des Plaines, IL (US)

( * ) Notice: Subject to any disclaimer, the term of this patent is extended or adjusted under 35 U.S.C. 154(b) by 95 days.

(21) Appl. No.: 11/540,793

(22) Filed: Sep. 28, 2006

(51) Int. Cl.
*C07C 4/06* (2006.01)
*C10G 11/05* (2006.01)
*C10G 11/18* (2006.01)

(52) U.S. Cl. ..... 585/653; 585/644; 585/648; 585/650; 585/651; 208/49; 208/70; 208/92; 208/93; 208/100; 208/113; 208/114; 208/118; 208/120.01

(58) Field of Classification Search ..... 208/113, 208/114, 118, 120.01, 49, 70, 92, 93, 100; 585/644, 648, 650, 651, 653
See application file for complete search history.

(56) References Cited

U.S. PATENT DOCUMENTS

| | | | | |
|---|---|---|---|---|
| 2,813,920 | A | 11/1957 | Cobb, Jr. | |
| 2,863,527 | A | 12/1958 | Herbert et al. | |
| 3,409,693 | A | 11/1968 | McHarg | |
| 3,552,924 | A | 1/1971 | Hepp | |
| 3,702,886 | A | 11/1972 | Argauer et al. | |
| 3,829,521 | A | 8/1974 | Green | |
| 4,003,822 | A | 1/1977 | Jo | |
| 4,072,604 | A | 2/1978 | Ward | |
| 4,894,141 | A | 1/1990 | Busch et al. | |
| 5,110,446 | A * | 5/1992 | Harandi et al. | 208/100 |
| 5,360,533 | A | 11/1994 | Tagamolila et al. | |
| 5,447,621 | A | 9/1995 | Hunter | |
| 5,584,985 | A | 12/1996 | Lomas | |
| 5,858,206 | A | 1/1999 | Castillo | |
| 5,859,304 | A | 1/1999 | Barchas et al. | |
| 6,110,356 | A | 8/2000 | Hedrick et al. | |
| 6,139,605 | A | 10/2000 | Carnell et al. | |
| 6,464,858 | B1 | 10/2002 | Brown et al. | |
| 6,538,169 | B1 | 3/2003 | Pittman et al. | |
| 6,540,907 | B1 | 4/2003 | Towler et al. | |
| 6,576,805 | B2 | 6/2003 | Keady et al. | |
| 6,726,835 | B2 | 4/2004 | Towler et al. | |
| 6,838,587 | B2 | 1/2005 | Lattner et al. | |
| 6,843,906 | B1 | 1/2005 | Eng | |
| 6,927,314 | B1 | 8/2005 | Schultz et al. | |
| 6,946,068 | B2 | 9/2005 | Groten | |
| 7,074,971 | B2 | 7/2006 | Van Egmond et al. | |
| 7,312,370 | B2 | 12/2007 | Pittman et al. | |
| 2003/0121825 | A1 * | 7/2003 | Pittman et al. | 208/113 |

FOREIGN PATENT DOCUMENTS

EP 1 637 577 A2 3/2006

OTHER PUBLICATIONS

U.S. Appl. No. 11/540,110, filed Sep. 28, 2006, Schultz.

(Continued)

*Primary Examiner*—Glenn Caldarola
*Assistant Examiner*—Prem C. Singh
(74) *Attorney, Agent, or Firm*—James C Paschall

(57) ABSTRACT

Processing schemes and arrangements are provided for the processing a heavy hydrocarbon feedstock via hydrocarbon cracking processing with selected hydrocarbon fractions being obtained via fractionation-based product recovery.

16 Claims, 1 Drawing Sheet

OTHER PUBLICATIONS

U.S. Appl. No. 11/541,218, filed Sep. 28, 2006, Wegerer.
U.S. Appl. No. 11/541,310, filed Sep. 28, 2006, Towler.
U.S. Appl. No. 11/540,088, filed Sep. 28, 2006, Schultz.
U.S. Appl. No. 11/541,200, filed Sep. 28, 2006, Schultz.

* cited by examiner

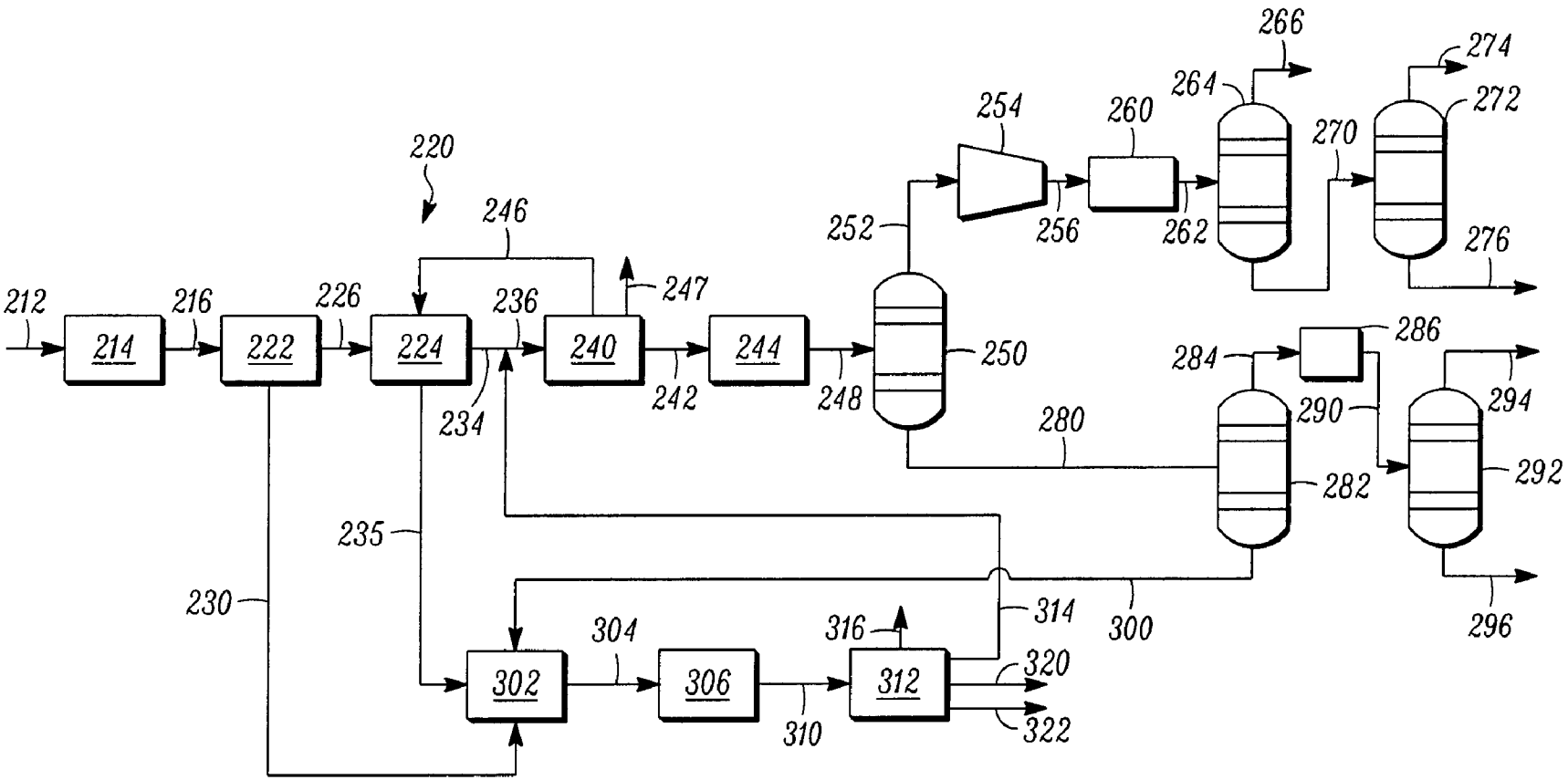
212
214
216
222
226
224
220
246
236
234
240
247
242
244
248
252
250
254
256
260
262
264
266
270
272
274
276
280
282
284
286
290
292
294
296
300
302
304
306
310
312
314
316
320
322
230
235

FRACTIONATION RECOVERY PROCESSING OF FCC-PRODUCED LIGHT OLEFINS

BACKGROUND OF THE INVENTION

This invention relates generally to hydrocarbon processing and, more particularly, to the processing of hydrocarbon-containing materials having a high light olefin content, such as produced or formed in or by the cracking of a heavy hydrocarbon feedstock.

Light olefins serve as feed materials for the production of numerous chemicals. Light olefins have traditionally been produced through the processes of steam or catalytic cracking of hydrocarbons such as derived from petroleum sources. Fluidized catalytic cracking (FCC) of heavy hydrocarbon streams is commonly carried out by contacting a starting material whether it be vacuum gas oil, reduced crude, or another source of relatively high boiling hydrocarbons with a catalyst such as composed of finely divided or particulate solid material. The catalyst is transported in a fluid-like manner by transmitting a gas or vapor through the catalyst at sufficient velocity to produce a desired regime of fluid transport. Contact of the oil with the fluidized material catalyzes the cracking reaction.

The cracking reaction typically deposits coke on the catalyst. Catalyst exiting the reaction zone is commonly referred to as being "spent", i.e., partially deactivated by the deposition of coke upon the catalyst. Coke is comprised of hydrogen and carbon and can include, in trace quantities, other materials such as sulfur and metals such that may enter the process with the starting material. The presence of coke interferes with the catalytic activity of the spent catalyst. It is believed that the coke blocks acid sites on the catalyst surface where the cracking reactions take place. Spent catalyst is traditionally transferred to a stripper that removes adsorbed hydrocarbons and gases from catalyst and then to a regenerator for the purpose of removing the coke by oxidation with an oxygen-containing gas. An inventory of catalyst having a reduced coke content, relative to the spent catalyst in the stripper, hereinafter referred to as regenerated catalyst, is collected for return to the reaction zone. Oxidizing the coke from the catalyst surface releases a large amount of heat, a portion of which escapes the regenerator with gaseous products of coke oxidation generally referred to as flue gas. The balance of the heat leaves the regenerator with the regenerated catalyst. The fluidized catalyst is continuously circulated between the reaction zone and the regeneration zone. The fluidized catalyst, as well as providing a catalytic function, serves as a vehicle for the transfer of heat from zone to zone. FCC processing is more fully described in U.S. Pat. No. 5,360,533 to Tagamolila et al., U.S. Pat. No. 5,584,985 to Lomas, U.S. Pat. No. 5,858,206 to Castillo and U.S. Pat. No. 6,843,906 B1 to Eng, the contents of each of these patents are hereby incorporated herein by reference. Specific details of the various contact zones, regeneration zones, and stripping zones along with arrangements for conveying the catalyst between the various zones are well known to those skilled in the art.

The FCC reactor serves to crack gas oil or heavier feeds into a broad range of products. Cracked vapors from an FCC unit enter a separation zone, typically in the form of a main column, that provides a gas stream, a gasoline cut, light cycle oil (LCO) and clarified oil (CO) which includes heavy cycle oil (HCO) components. The gas stream may include dry gas, i.e., hydrogen and $C_1$ and $C_2$ hydrocarbons, and liquefied petroleum gas ("LPG"), i.e., $C_3$ and $C_4$ hydrocarbons, also sometimes commonly referred to as wet gas.

In view of an increasing need and demand for light olefins such as ethylene and propylene for various petrochemical uses such as for the production of polyethylene, polypropylene and the like as well as the desire to produce relatively less of heavier olefins such as butylenes and pentenes which are generally less desirable as gasoline blending components due to environmental considerations, it may be desired to practice the cracking reaction processing of heavy hydrocarbon feedstock to increase the relative amount of light olefins in the resulting product slate.

Research efforts have led to the development of an FCC process that produces or results in greater relative yields of light olefins, i.e., ethylene and propylene. Such processing is more fully described in U.S. Pat. No. 6,538,169 B1 to Pittman et al., the contents of which are hereby fully incorporated herein by reference. As disclosed therein, a hydrocarbon feed stream can desirably be contacted with a blended catalyst comprising regenerated catalyst and coked catalyst. The catalyst has a composition including a first component and a second component. The second component comprises a zeolite with no greater than medium pore size wherein the zeolite comprises at least 1 wt. % of the catalyst composition. The contacting occurs in a riser to crack hydrocarbons in the feed stream and obtain a cracked stream containing hydrocarbon products including light olefins and coked catalyst. The cracked stream is passed out of an end of the riser such that the hydrocarbon feed stream is in contact with the blended catalyst in the riser for less than or equal to 2 seconds on average.

In view of the increasing need and demand for light olefins such as ethylene and propylene, there is a need and a demand for improved processing and arrangements for the separation and recovery of such light olefins from such FCC processing effluent.

SUMMARY OF THE INVENTION

A general object of the invention is to provide an improved process and system for catalytically cracking a heavy hydrocarbon feedstock and obtaining selected hydrocarbon fractions.

The general object of the invention can be attained, at least in part, through a specified process such as involves contacting a heavy hydrocarbon feedstock with a hydrocarbon cracking catalyst in a fluidized reactor zone to produce a hydrocarbon effluent comprising a range of hydrocarbon products including light olefins. In accordance with one preferred embodiment, the hydrocarbon cracking catalyst desirably is of a catalyst composition including a first component comprising a large pore molecular sieve and a second component comprising a zeolite with no greater than medium pore size, said zeolite with no greater than medium pore size comprising at least 1.0 wt. % of the catalyst composition. The hydrocarbon effluent is separated in a separation section to form at least one separator liquid stream and a separator vapor stream. The at least one separator liquid stream comprises $C_4$+ hydrocarbons. The separator vapor stream comprises $C_4$− hydrocarbons. At least a portion of the separator vapor stream is deethanized to at least form a first deethanizer process stream comprising $C_2$− hydrocarbons including a quantity of ethylene and a second deethanizer process stream comprising $C_3$+ hydrocarbons including a quantity of propylene. The first deethanizer process stream is demethanized to form a first demethanizer process stream comprising hydrogen and methane and a second demethanizer process stream comprising $C_2$ hydrocarbons including at least a portion of the quantity of ethylene. The second demethanizer product stream is subsequently split in a $C_2$ hydrocarbon splitter to form a first $C_2$ hydrocarbon splitter process stream comprising ethylene and a second $C_2$ hydrocarbon splitter process stream comprising ethane.

The prior art generally fails to provide processing schemes and arrangements for obtaining light olefins via the catalytic cracking of a heavy hydrocarbon feedstock in an as effective and efficient a manner as may be desired. More particularly, the prior art generally fails to provide such processing schemes and arrangements that advantageously utilize fractionation processing of hydrocarbon effluent products to produce or otherwise form process streams containing specifically desired ranges of hydrocarbons.

A process for catalytically cracking a heavy hydrocarbon feedstock and obtaining selected hydrocarbon fractions, in accordance with another embodiment involves contacting a heavy hydrocarbon feedstock with a hydrocarbon cracking catalyst having a catalyst composition including a first component comprising a large pore molecular sieve and a second component comprising a zeolite with no greater than medium pore size. In accordance with one preferred practice of such embodiment, the zeolite desirably has no greater than medium pore size comprises at least 1.0 wt. % of the catalyst composition. The hydrocarbon effluent is separated in a separation section to form at least one separator liquid stream and a separator vapor stream. The at least one separator liquid stream comprises $C_4$+ hydrocarbons. The separator vapor stream comprises $C_4$− hydrocarbons. The process further requires that at least a portion of the separator vapor stream be deethanized to at least form a first deethanizer process stream comprising $C_2$− hydrocarbons including a quantity of ethylene and a second deethanizer process stream comprising $C_3$+ hydrocarbons including a quantity of propylene. The second deethanizer process stream is depropanized to form a first depropanizer process stream comprising $C_3$− hydrocarbons including a quantity of propylene and a second depropanizer process stream comprising $C_4$+ hydrocarbons. The at least one separator liquid stream comprising $C_4$+ hydrocarbons can be desirably combined with the second depropanizer process stream comprising $C_4$+ hydrocarbons.

A system for catalytically cracking a heavy hydrocarbon feedstock and obtaining selected hydrocarbon fractions is also provided. In accordance with one preferred embodiment, such as system includes a fluidized reactor zone wherein the heavy hydrocarbon feedstock contacts a hydrocarbon cracking catalyst having a catalyst composition including a first component comprising a large pore molecular sieve and a second component comprising a zeolite with no greater than medium pore size to produce a hydrocarbon effluent comprising a range of hydrocarbon products including light olefins. The zeolite is desirably with no greater than medium pore size comprising at least 1.0 wt. % of the catalyst composition.

The system further includes a separation section to separate the cracked effluent stream to form at least one separator liquid stream and a separator vapor stream. The at least one separator liquid stream desirably comprises $C_4$+ hydrocarbons. The separator vapor stream desirably comprises $C_4$− hydrocarbons. A deethanizer is provided to deethanize at least a portion of the separator vapor stream to at least form a first deethanizer process stream comprising $C_2$− hydrocarbons including a quantity of ethylene and a second deethanizer process stream comprising $C_3$+ hydrocarbons including a quantity of propylene. A demethanizer is provided to demethanize the first deethanizer process stream to form a first demethanizer process stream comprising hydrogen and methane and a second demethanizer process stream comprising $C_2$ hydrocarbons including at least a portion of the quantity of ethylene. The system further includes a $C_2$ hydrocarbon splitter to split the second demethanizer product stream to form a first $C_2$ hydrocarbon splitter process stream comprising ethylene and a second $C_2$ hydrocarbon splitter process stream comprising ethane.

As used herein, references to "light olefins" are to be understood to generally refer to $C_2$ and $C_3$ olefins, i.e., ethylene and propylene, alone or in combination.

References to light olefin materials or appropriate process streams as being "substantially free of carbon dioxide" are to be understood to generally refer to such light olefin materials or process streams as desirably generally containing less than about 100 ppm of carbon dioxide, preferably containing less than about 10 ppm of carbon dioxide and, more preferably, desirably containing less than about 1 ppm of carbon dioxide.

References to a process stream as "ethylene-rich" are to be understood to generally refer to such process streams as generally contain at least 20 percent ethylene and, in accordance with at least certain preferred embodiments alternatively contain at least 25 percent ethylene, at least 30 percent ethylene, at least 35 percent ethylene, at least 40 percent ethylene or about 40 to about 60 percent ethylene.

References to "$C_x$ hydrocarbon" are to be understood to refer to hydrocarbon molecules having the number of carbon atoms represented by the subscript "x". Similarly, the term "$C_x$-containing stream" refers to a stream that contains $C_x$ hydrocarbon. The term "$C_x$+ hydrocarbons" refers to hydrocarbon molecules having the number of carbon atoms represented by the subscript "x" or greater. For example, "$C_4$+ hydrocarbons" include $C_4$, $C_5$ and higher carbon number hydrocarbons. The term "$C_x$− hydrocarbons" refers to hydrocarbon molecules having the number of carbon atoms represented by the subscript "x" or fewer. For example, "$C_4$− hydrocarbons" include $C_4$, $C_3$ and lower carbon number hydrocarbons.

Other objects and advantages will be apparent to those skilled in the art from the following detailed description taken in conjunction with the appended claims and drawing.

BRIEF DESCRIPTION OF THE DRAWING

The FIGURE is a simplified schematic diagram of a system for catalytic cracking a heavy hydrocarbon feedstock and obtaining selected hydrocarbon fractions, including light olefins via fractionation recovery, in accordance with one preferred embodiment.

DETAILED DESCRIPTION

Processing schemes and arrangements are provided for effectively and efficiently processing a heavy hydrocarbon feedstock via hydrocarbon cracking processing with selected hydrocarbon fractions being obtained via fractionation recovery The FIGURE schematically illustrates a system, generally designated by the reference numeral 210, for catalytic cracking a heavy hydrocarbon feedstock and obtaining light olefins via fractionation recovery, in accordance with one embodiment of the invention. Those skilled in the art and guided by the teachings herein provided will recognize and appreciate that the illustrated system has been simplified by the elimination of various usual or customary pieces of process equipment including some heat exchangers, process control systems, pumps, fractionation systems, and the like. It may also be discerned that the process flow depicted in the FIGURES may be modified in many aspects without departing from the basic overall concept of the invention.

In the system 210, a suitable heavy hydrocarbon feedstock stream is introduced via a line 212 into a fluidized reactor zone 214 wherein the heavy hydrocarbon feedstock contacts with a hydrocarbon cracking catalyst zone to produce a hydrocarbon effluent comprising a range of hydrocarbon products, including light olefins.

Suitable fluidized catalytic cracking reactor zones for use in the practice of such an embodiment may, as is described in above-identified U.S. Pat. No. 6,538,169 B1 to Pittman et al., include a separator vessel, a regenerator, a blending vessel, and a vertical riser that provides a pneumatic conveyance zone in which conversion takes place. The arrangement circulates catalyst and contacts feed in a specifically described manner.

More specifically and as described therein, the catalyst typically comprises two components that may or may not be on the same matrix. The two components are circulated throughout the entire system. The first component may include any of the well-known catalysts that are used in the art of fluidized catalytic cracking, such as an active amorphous clay-type catalyst and/or a high activity, crystalline molecular sieve. Molecular sieve catalysts are preferred over amorphous catalysts because of their much-improved selectivity to desired products. Zeolites are the most commonly used molecular sieves in FCC processes. Preferably, the first catalyst component comprises a large pore zeolite, such as a Y-type zeolite, an active alumina material, a binder material, comprising either silica or alumina and an inert filler such as kaolin.

The zeolitic molecular sieves appropriate for the first catalyst component should have a large average pore size. Typically, molecular sieves with a large pore size have pores with openings of greater than 0.7 nm in effective diameter defined by greater than 10 and typically 12 membered rings. Pore Size Indices of large pores are above about 31. Suitable large pore zeolite components include synthetic zeolites such as X-type and Y-type zeolites, mordenite and faujasite. It has been found that Y zeolites with low rare earth content are preferred in the first catalyst component. Low rare earth content denotes less than or equal to about 1.0 wt-% rare earth oxide on the zeolite portion of the catalyst. Octacat™ catalyst made by W. R. Grace & Co. is a suitable low rare earth Y-zeolite catalyst.

The second catalyst component comprises a catalyst containing, medium or smaller pore zeolite catalyst exemplified by ZSM-5, ZSM-11, ZSM-12, ZSM-23, ZSM-35, ZSM-38, ZSM-48, and other similar materials. U.S. Pat. No. 3,702,886 describes ZSM-5. Other suitable medium or smaller pore zeolites include ferrierite, erionite, and ST-5, developed by Petroleos de Venezuela, S.A. The second catalyst component preferably disperses the medium or smaller pore zeolite on a matrix comprising a binder material such as silica or alumina and an inert filer material such as kaolin. The second component may also comprise some other active material such as Beta zeolite. These catalyst compositions have a crystalline zeolite content of 10-25 wt. % or more and a matrix material content of 75-90 wt. %. Catalysts containing 25 wt. % crystalline zeolite material are preferred. Catalysts with greater crystalline zeolite content may be used, provided they have satisfactory attrition resistance. Medium and smaller pore zeolites are characterized by having an effective pore opening diameter of less than or equal to 0.7 nm, rings of 10 or fewer members and a Pore Size Index of less than 31.

The total catalyst composition should contain 1-10 wt. % of a medium to small pore zeolite with greater than or equal to 1.75 wt. % being preferred. When the second catalyst component contains 25 wt. % crystalline zeolite, the composition contains 4-40 wt. % of the second catalyst component with a preferred content of greater than or equal to 7 wt. %. ZSM-5 and ST-5 type zeolites are particularly preferred since their high coke resistivity will tend to preserve active cracking sites as the catalyst composition makes multiple passes through the riser, thereby maintaining overall activity. The first catalyst component will comprise the balance of the catalyst composition. The relative proportions of the first and second components in the catalyst composition will not substantially vary throughout the FCC unit.

The high concentration of the medium or smaller pore zeolite in the second component of the catalyst composition improves selectivity to light olefins by further cracking the lighter naphtha range molecules. But at the same time, the resulting smaller concentration of the first catalyst component still exhibits sufficient activity to maintain conversion of the heavier feed molecules to a reasonably high level.

The relatively heavier feeds suitable for processing in accordance herewith include conventional FCC feedstocks or higher boiling or residual feeds. A common conventional feedstock is vacuum gas oil which is typically a hydrocarbon material prepared by vacuum fractionation of atmospheric residue and which has a broad boiling range of from 315-622° C. (600-1150° F.) and, more typically, which has a narrower boiling point range of from 343-551° C. (650-1025° F.). Heavy or residual feeds, i.e., hydrocarbon fractions boiling above 499° C. (930° F.), are also suitable. The fluidized catalytic cracking processing the invention is typically best suited for feedstocks that are heavier than naptha range hydrocarbons boiling above about 177° C. (350° F.).

The effluent from the fluidized reactor zone 214 is passed through a line 216 into a hydrocarbon separation system 220, such as includes a main column section 222 and a staged compression section 224. The main column section 222 may desirably include a main column separator with an associated main column overhead high pressure receiver wherein the fluidized reactor zone effluent can be separated into desired fractions including a main column vapor stream, such as passed through a line 226, and a main column liquid stream, such as passed through a line 230.

To facilitate illustration and discussion, other fraction lines such as including a heavy gasoline stream, a light cycle oil ("LCO") stream, a heavy cycle oil ("HCO") stream and a clarified oil ("CO") stream, for example, may not here be shown nor hereinafter specifically described.

The main column vapor stream line 226 is introduced into the staged compression section 224, such as constituting a three-stage compression. The staged compression section 224 results in the formation of a high pressure separator vapor stream in a line 234. Such high pressure separator vapor stream typically primarily comprises $C_4$– hydrocarbons and includes a quantity of carbon dioxide. While the pressure of such high pressure vapor and, in turn, corresponding high pressure liquid, can vary, in practice such streams are typically at a pressure in the range of about 1650 kPa to about 1930 kPa (about 240 psia to about 280 psia).

The compression section 224 may also result in the formation of a stream of spill back materials largely composed of heavier hydrocarbon materials and typically in the form of a liquid. Such liquid material typically primarily comprises $C_4$+ hydrocarbons and is substantially free of carbon dioxide. Such spill back material can be passed via one or more lines 235 for further processing or treatment as later described herein.

The separator vapor stream is passed via the lines 234 and 236 and if desired and as shown may be introduced into an amine treatment section 240 such as may be desired to effect $CO_2$ removal therefrom. The utilization of amine treatment systems for carbon dioxide and/or hydrogen sulfide removal are well known in the art. Conventional such amine treatment systems typically employ an amine solvent such as methyl diethanol amine [MDEA] to absorb or otherwise separate $CO_2$ from hydrocarbon stream materials. A stripper or regenerator is typically subsequently used to strip the absorbed $CO_2$ from the amine solvent, permitting the reuse of the amine solvent.

While such amine treatment has proven generally effective for removal of carbon dioxide from various hydrocarbon-containing streams, the application of such amine treatment to ethylene-rich hydrocarbon and carbon dioxide-containing streams, such as being processed at this point of the subject system, may experience some undesired complications as some of the olefin material may be co-absorbed with the $CO_2$ in or by the amine solvent. Such co-absorption of olefin material undesirably reduces the amounts of light olefins available for recovery from such processing. Moreover, during such subsequent stripper processing of the amine solvent, the presence of such olefin materials can lead to polymerization. Such polymerization can lead to degradation of the amine solvent and require expensive off-site reclamation processing.

In view thereof, it may be desirable to utilize an amine treatment system such as includes or incorporates a pre-stripper interposed between the amine system absorber and the amine system stripper/regenerator. Such an interposed pre-stripper, can desirably serve to separate hydrocarbon materials, including light olefins such as ethylene, from the carbon dioxide and amine solvent prior to subsequent processing through the regenerator/stripper.

A stream containing $C_4$− hydrocarbons substantially free of carbon dioxide is passed through a line 242 to a drier section 244, such as in the form of an adsorbent drier. Those skilled in the art and guided by the teachings herein provided will, however, appreciate that suitable other forms of driers such as known in the art can, if desired, be used.

A stream containing stripped hydrocarbons and possibly minor amounts (e.g., typically less than 1 wt. %) of $CO_2$ is conveyed via a line 246 back to the compression section 224 such as for further processing such as consistent with the above description.

A stream containing $CO_2$ rich purge gas, such as corresponding to the purge line 80 from the second stripping zone 16 in the above-described amine treatment system 10, is conveyed from the amine treatment section 240 via a line 247.

A stream containing dried $C_4$− hydrocarbons substantially free of carbon dioxide is passed via a line 248 to a deethanizer 250. A suitable such deethanizer, in accordance with one preferred embodiment, generally desirably operates at a feed temperature in the range of about 54° C. (corresponding to operation with no post compression heat exchange) to about −40° C. (about 130° F. to about −40° F.) and in accordance with a preferred embodiment with a feed temperature in the range of about 17° C. to about −40° C. (about 0° F. to about −40° F.), more preferably at about −40° C. (about −40° F.); a top tray temperature in the range of about −34° C. to about −46° C. (about −30° F. to about −50° F.) and in accordance with a preferred top tray temperature of about −46 C.° (about −50° F.); and with a $C_2$ recovery generally of at least 98 mol %, preferably with a $C_2$ recovery of at least 99 mol % to about 99.9 mol % and, more preferably with a $C_2$ recovery of at least 99.9 mol %.

From the deethanizer 250, a stream of $C_2$− hydrocarbons is taken overhead via a line 252. The line 252 and the stream of materials therein contained are introduced into a compressor section 254 to form a corresponding stream of compressed materials (such as being at a pressure in the range of about 3720 kPag to about 3865 kPag (about 540 psig to about 560 psig)) that are passed through a line 256 to an acetylene conversion section or unit 260. As is known in the art, acetylene conversion sections or units are effective to convert acetylene to form ethylene. Thus, an additionally ethylene-enriched process stream is withdrawn in a line 262 from the acetylene conversion section or unit 260.

The process stream in the line 262 is introduced into a demethanizer 264. A suitable such demethanizer, in accordance with one preferred embodiment, includes a condenser (not specifically shown) that desirably operates at a temperature of no greater than about −90° C. (−130° F.), more preferably operates at a temperature in the range of about −90° C. to about −102° C., preferably about −96° C. (−130° to about −150° F., preferably at about −140° F.). In addition, a preferred demethanizer for use in the practice of the invention desirably operates with a methane to ethylene molar ratio in the bottoms of no greater than about 0.0005 and, more preferably at a methane to ethylene molar ratio in the bottoms of no greater than about 0.0003 to about 0.0002.

A stream of methane and hydrogen gas from the demethanizer 264 is taken overhead by via a line 266 such as for use as a fuel or, if desired for further processing or treatment such as to a pressure swing absorption unit (not shown) for $H_2$ recovery. A line 270 withdraws a stream of demethanized material from the demethanizer 264. The stream of demethanized material in line 270 is passed to an ethylene/ethane splitter 272. A suitable such ethane/ethylene splitter, in accordance with one preferred embodiment, includes a condenser (not specifically shown) that desirably operates at a pressure in the range of about 1930 kPag to about 2105 kPag (about 280 psig to about 305 psig), and desirably operates such that there is no more than about 0.5 vol. % ethane in the ethylene product stream, preferably less than about 0.1 vol. % ethane in the ethylene product stream and, more preferably, less than about 0.05 vol. % ethane in the ethylene product stream.

The ethylene/ethane splitter 272 forms a stream of ethylene and a stream of ethane which are passed through lines 274 and 276, respectively, such as either for product recovery or further desired processing, as is known in the art.

The deethanizer 250 also produces or forms a stream of $C_3$+ hydrocarbons such as withdrawn therefrom via a line 280. The line 280 introduces the materials passing therein into a depropanizer 282. A suitable such depropanizer, in accordance with one preferred embodiment, includes a condenser (not specifically shown) that desirably operates at a pressure in the range of about 1030 kPag to about 1175 kPag (about 150 psig to about 170 psig), with a recovery of at least about 98 mol % of the $C_3$ hydrocarbons in the overhead, more preferably with the recovery of at least in the range of 98-99.5 mol % of the $C_3$ hydrocarbons in the overhead and at least 95 mol % of the $C_4$+ hydrocarbons in the bottoms product, more preferably with the recovery of at least about 95 mol % to about 99 mol % of the $C_4$+ hydrocarbons in the bottoms product.

A stream of $C_3$ hydrocarbons is taken overhead from the depropanizer 282 via a line 284. This stream of $C_3$ hydrocarbons, in addition to propane and propylene may contain significant relative amounts or quantities of $C_3$ diolefin hydrocarbons. Thus, as shown and in accordance with one preferred embodiment, the system 210 may desirably include or contain a selective hydrogenation process unit 286 to convert such diolefinic materials to corresponding olefin materials.

The resulting stream is passed via a line 290 to a propylene/propane splitter 292. A suitable such propane/propylene splitter, in accordance with one preferred embodiment, desirably operates such that at least 98 wt. % and, preferably, at least about 99 wt. % of the propylene recovery is in the overhead stream and the propylene in the overhead stream is at least about 99.5% pure.

The propylene/propane splitter 292 forms a stream of propylene and a stream of propane which are passed through lines 294 and 296, respectively, such as either for product recovery or further desired processing, as is known in the art.

A line 300 withdraws a stream containing residual $C_4$+ hydrocarbons from the depropanizer 282. If desired and as shown, the line 300 with the stream containing residual $C_4$+ hydrocarbons from the depropanizer 282 can be introduced into a mercaptan treatment section 302, such as to effect mercaptan removal from the stream materials such as via caustic wash as is known in the art. In the illustrated embodiment, the liquid line 235 and the main column liquid stream line 230 are also introduced into the mercaptan treatment section 302 such as to effect mercaptan removal therefrom.

The resulting stream is withdrawn therefrom via a line 304. As such stream materials may contain diolefinic materials, in the illustrated embodiment, the line 304 is shown as leading into a selective hydrogenation process unit 306 to convert such diolefinic materials to corresponding olefin materials. The resulting stream containing $C_4$+ hydrocarbons is passed via a line 310 such as either for product recovery or further desired processing, as is known in the art.

While in the above-described embodiment, the line 300 containing the stream of residual $C_4$+ hydrocarbons withdrawn from the depropanizer 282 has been shown as being introduced into the mercaptan treatment section 302, those skilled in the art and guided by the teaching herein provided will appreciate that the broader practice of the invention is not necessarily so limited. For example, if desired, such as in instances or situations wherein such stream of residual $C_4$+ hydrocarbons contains little or no mercaptans, such stream of materials can be passed directly to the selective hydrogenation process unit 306.

In accordance with one preferred embodiment and as shown in the FIGURE, the resulting stream containing $C_4$+ hydrocarbons can desirably be passed via the line 310 to a further treatment and/or separation zone, generally designated by the reference numeral 312. In accordance with certain alternate preferred embodiments, such a further treatment and/or separation zone may incorporate one or more of an olefinic cracking, metathesis and alkylation processing unit alone or together with a further product separation zone, such as known in the art. For example, in an embodiment wherein the further treatment and/or separation zone 312 comprises an olefin cracking and further product separation zone, at least a portion of the $C_4$+ olefins may desirably be cracked, such as in a manner known in the art, to form a cracked olefin effluent comprising $C_2$ and $C_3$ olefins, shown as passing in a line 314, and such as can be further conveyed in the line 236 for further processing as hereinabove described.

In the illustrated embodiment, the further treatment and/or separation zone 312 also provides or results in a stream containing $C_4$ hydrocarbon materials, a stream containing $C_7$-$C_9$ hydrocarbons and a stream containing $C_{10}$+ hydrocarbons, withdrawn via lines 316, 320 and 322, respectively, and such as can be appropriately passed for further processing or product recovery, as may be desired. Those skilled in the art and guided by the teachings herein provided will appreciate that other product streams, such as known in the art, may also be formed and thus the broader practice of the invention is not necessarily limited to the specific products streams herein shown or described.

Thus processing schemes and arrangements are desirably provided for obtaining light olefins via the catalytic cracking of a heavy hydrocarbon feedstock. More particularly, processing schemes and arrangements are provided that advantageously utilize fractionation of hydrocarbon effluent products to produce or otherwise form process streams containing specifically desired ranges of hydrocarbons.

The invention illustratively disclosed herein suitably may be practiced in the absence of any element, part, step, component, or ingredient which is not specifically disclosed herein.

While in the foregoing detailed description this invention has been described in relation to certain preferred embodiments thereof, and many details have been set forth for purposes of illustration, it will be apparent to those skilled in the art that the invention is susceptible to additional embodiments and that certain of the details described herein can be varied considerably without departing from the basic principles of the invention.

What is claimed is:

1. A process for catalytically cracking a heavy hydrocarbon feedstock and obtaining selected hydrocarbon fractions, the process comprising:

contacting a heavy hydrocarbon feedstock with a hydrocarbon cracking catalyst in a fluidized reactor zone to produce a hydrocarbon effluent comprising a range of hydrocarbon products including light olefins, the hydrocarbon cracking catalyst having a catalyst composition including a first component comprising a large pore molecular sieve and a second component comprising a zeolite with no greater than medium pore size, said zeolite with no greater than medium pore size comprising at least 1.0 wt. % of the catalyst composition;

separating the hydrocarbon effluent in a separation system comprising a main column section and a compression section to form at least one separator liquid stream and a separator vapor stream, the main column section providing one or more cuts selected from the group consisting of gasoline, light cycle oil, heavy cycle oil and clarified oil, and the at least one separator liquid stream comprising $C_4$+ hydrocarbons, the separator vapor stream comprising $C_4$− hydrocarbons;

deethanizing at least a portion of the separator vapor stream to at least form a first deethanizer process stream comprising $C_2$− hydrocarbons including a quantity of ethylene and a second deethanizer process stream comprising $C_3$+ hydrocarbons including a quantity of propylene;

demethanizing the first deethanizer process stream to form a first demethanizer process stream comprising hydrogen and methane and a second demethanizer process stream comprising $C_2$ hydrocarbons including at least a portion of the quantity of ethylene;

splitting the second demethanizer product stream in a $C_2$ hydrocarbon splitter to form a first $C_2$ hydrocarbon splitter process stream comprising ethylene and a second $C_2$ hydrocarbon splitter process stream comprising ethane;

depropanizing the second deethanizer process stream to form a first depropanizer process stream comprising $C_3$− hydrocarbons including a quantity of propylene and a second depropanizer process stream comprising $C_4$+ hydrocarbons; and treating at least a portion of the at least one separator liquid stream and at least a portion of the second depropanizer process stream in at least a single downstream processing unit.

2. The process of claim 1 wherein said contacting of the heavy hydrocarbon feedstock with a hydrocarbon cracking catalyst comprises contacting the heavy hydrocarbon feedstock with a blended catalyst comprising regenerated catalyst and coked catalyst in a fluidized reactor zone at hydrocarbon cracking reaction conditions to produce a cracked stream containing hydrocarbon products including light olefins.

3. The process of claim 1 wherein the at least one separator liquid stream and the second depropanizer process stream each comprises a quantity of $C_4$+ diolefin hydrocarbons and the treating of at least a portion of the at least one separator liquid stream and at least a portion of the second depropanizer process stream in a single downstream processing unit comprises:

introducing the at least one separator liquid stream and the second depropanizer process stream into a hydrogenation unit to hydrogenate at least a portion of the quantity of $C_4$+ diolefin hydrocarbons of the at least one separator liquid stream and the second depropanizer process stream to form a process stream comprising $C_4$+ hydrocarbons substantially free of diolefinic hydrocarbons.

4. The process of claim 3 additionally comprising at least a portion of the process stream comprising $C_4$+ hydrocarbons substantially free of diolefinic hydrocarbons being subjected to at least one further hydrocarbon processing step selected from the group of olefin cracking, metathesis and alkylation processing.

5. The process of claim 1 additionally comprising:

splitting at least a portion of the first depropanizer process stream in a $C_3$ hydrocarbon splitter to form a first $C_3$ hydrocarbon splitter product stream comprising propylene and a second $C_3$ hydrocarbon splitter product stream comprising propane.

6. The process of claim 1 wherein the $C_3$− hydrocarbons of the first depropanizer process stream additionally comprise a quantity of $C_3$ diolefin hydrocarbons, the process additionally comprising:

hydrogenating at least a portion of the quantity of $C_3$ diolefin hydrocarbons to form additional propylene prior to said splitting in the $C_3$ hydrocarbon splitter.

7. The process of claim 1 wherein at least one of the at least one separator liquid stream comprising $C_4$+ hydrocarbons and the second depropanizer process stream comprising $C_4$+ hydrocarbons comprise $C_4$-$C_7$ olefins, the process additionally comprising:

cracking at least a portion of the $C_4$-$C_7$ olefins to form a cracked olefin effluent comprising $C_2$ and $C_3$ olefins.

8. The process of claim 1 additionally comprising:

compressing the first deethanizer process stream prior to said demethanizing.

9. The process of claim 8 wherein the first deethanizer process stream additionally comprises a quantity of acetylene, the process additionally comprising:

subsequent to said compressing, converting at least a portion of the quantity of acetylene to form a first deethanizer process stream enriched in ethylene.

10. The process of claim 1 wherein the first deethanizer process stream additionally comprises a quantity of acetylene and wherein, prior to said demethanizing, said process additionally comprises:

converting at least a portion of the quantity of acetylene to form a first deethanizer process stream enriched in ethylene.

11. A process for catalytically cracking a heavy hydrocarbon feedstock and obtaining selected hydrocarbon fractions, the process comprising:

contacting a heavy hydrocarbon feedstock with a hydrocarbon cracking catalyst having a catalyst composition including a first component comprising a large pore molecular sieve and a second component comprising a zeolite with no greater than medium pore size, said zeolite with no greater than medium pore size comprising at least 1.0 wt. % of the catalyst composition;

separating the hydrocarbon effluent in a separation system comprising a main column section and a compression section, said main column section passing a main column vapor stream to said compression section to form at least one separator liquid stream and a separator vapor stream, the at least one separator liquid stream comprising $C_4$+ hydrocarbons, the separator vapor stream comprising $C_4$− hydrocarbons;

deethanizing at least a portion of the separator vapor stream to at least form a first deethanizer process stream comprising $C_2$− hydrocarbons including a quantity of ethylene and a second deethanizer process stream comprising $C_3$+ hydrocarbons including a quantity of propylene;

depropanizing the second deethanizer process stream to form a first depropanizer process stream comprising $C_3$− hydrocarbons including a quantity of propylene and a second depropanizer process stream comprising $C_4$+ hydrocarbons; and combining the at least one separator liquid stream comprising $C_4$+ hydrocarbons with the second depropanizer process stream comprising $C_4$+ hydrocarbons.

12. The process of claim 11 wherein said contacting of the heavy hydrocarbon feedstock with a hydrocarbon cracking catalyst comprises contacting the heavy hydrocarbon feedstock with a blended catalyst comprising regenerated catalyst and coked catalyst in a fluidized reactor zone at hydrocarbon cracking reaction conditions to produce a cracked stream containing hydrocarbon products including light olefins.

13. The process of claim 11 additionally comprising:

splitting at least a portion of the first depropanizer process stream in a $C_3$ hydrocarbon splitter to form a first $C_3$ hydrocarbon splitter product stream comprising propylene and a second $C_3$ hydrocarbon splitter product stream comprising propane.

14. The process of claim 11 wherein the $C_3$− hydrocarbons of the first depropanizer process stream additionally comprise a quantity of $C_3$ diolefin hydrocarbons, the process additionally comprising:

hydrogenating at least a portion of the quantity of $C_3$ diolefin hydrocarbons to form additional propylene to prior to said splitting in the $C_3$ hydrocarbon splitter.

15. The process of claim 11 wherein the first deethanizer process stream additionally comprises a quantity of acetylene and wherein, prior to said demethanizing, said process additionally comprises:

converting at least a portion of the quantity of acetylene to form a first deethanizer process stream enriched in ethylene.

16. The process of claim 15 additionally comprising:

compressing the first deethanizer process stream prior to said converting of at least a portion of the quantity of acetylene.

* * * * *